US005328424A

United States Patent [19]

Greco

[11] Patent Number: 5,328,424

[45] Date of Patent: Jul. 12, 1994

[54] UPPER AND LOWER BODY EXERCISER THAT CAN BE USED BY PEOPLE WITH LOWER BODY PARALYSIS

[76] Inventor: Bruce C. Greco, 6187 Paseo Rio Verde, Anaheim, Calif. 92807

[21] Appl. No.: 33,813

[22] Filed: Mar. 19, 1993

[51] Int. Cl.[5] ..... A63B 69/06

[52] U.S. Cl. ..... 482/73; 482/72; 482/145; 482/142

[58] Field of Search ..... 482/72, 73, 142, 145, 482/133, 134, 135; 128/25 R

[56] References Cited

U.S. PATENT DOCUMENTS 4,621,623 11/1986 Wang ..... 482/73
4,756,523 7/1988 Rasmussen ..... 482/73
4,846,460 7/1989 Duke ..... 482/73
4,848,325 7/1989 Lillie ..... 128/25 R
4,863,157 9/1989 Mendel et al. ..... 128/25 R
4,928,957 5/1990 Lanier et al. ..... 482/73

*Primary Examiner*—Richard J. Apley
*Assistant Examiner*—Lynne A. Reichard

[57] ABSTRACT

An exercise device for people with lower body paralysis. The exercise device guides and resists the motion of the hands and feet away from and towards the trunk. The exercise device holds the feet at a nearly constant angle in relation to a line drawn between the ankles and hips. The arm motion is constantly mechanically linked to the leg motion so that voluntary arm motion causes motion of paralyzed legs. A knee guide keeps paralyzed legs in proper alignment. Arm motion controls the application of electrical stimulation to leg muscles. Electrical stimulation of leg muscles causes the generation of leg forces that contribute to the overcoming of the resistance to the movement of the hands and feet in relation to the trunk.

12 Claims, 6 Drawing Sheets

UPPER AND LOWER BODY EXERCISER THAT CAN BE USED BY PEOPLE WITH LOWER BODY PARALYSIS

BACKGROUND

1. Field of Invention

This invention relates to exercise machines, specifically to exercise machines which involve combined upper and lower body exercise with functional electrical stimulation of paralyzed lower body muscles.

2. Discussion of Prior Art

People with paralysis such as paraplegics and quadriplegics have large portions of their body which they are unable to move on their own. There are a multitude of health related problems associated with paralysis, some examples are; muscle atrophy, pressure sores, osteoporosis, loss of joint range of motion, cardiovascular disease, lack of cardiovascular endurance, lower body blood clot formation, edema, and spasticity.

Functional electrical stimulation is used to contract and thus exercise paralyzed muscles. Functional electrical stimulation involves applying small electrical currents to the nerves of a paralyzed muscle to cause it to contract. The electrical stimulation is typically applied through surface electrodes placed on the skin over the muscle to be contracted.

Typically, an individual with paralysis who is involved with functional electrical stimulation exercise will use an individual muscle group stimulator. While using this type of stimulator a person will typically exercise one muscle group at a time for 15 minutes. For example, one applies the stimulator electrodes over the top of the upper thigh, which is the quadriceps muscle, and performs knee extensions with a weight on the ankle. One goes through this process on each of the paralyzed muscles. This is a time consuming process since a typical complete paraplegic has five or more paralyzed muscle groups. Because it is very time consuming to go through all the paralyzed muscle groups with an individual muscle group stimulator, regular compliance is very low for this type of program. In addition, this type of program does very little to develop the cardiovascular system since only one muscle group at a time is active.

What is needed is an exercise device that exercises most of the paralyzed muscles at the same time while also exercising non-paralyzed muscles. A machine such as this saves time and provides better cardiovascular development when compared to an individual muscle group stimulator. Electrical stimulation stationary bicycles have been developed, however, they only stimulate the front and back upper thigh and the buttocks. They require complex electronics so that each muscle is only active during a certain range of the pedal crank arm rotation. Exercising three muscle groups at a time is still not enough to fully develop the cardiovascular system. The person exercising on the stationary bicycle will usually have to spend additional time electrically stimulating other muscles individually.

The common row machine might seem to be a good full body exercise device to utilize in combination with functional electrical stimulation. However, the resistance is applied through the movable hand grips on row machines. An able bodied individual regulates the force applied with the legs versus the force applied with the arms in order to produce the rowing motion. It would be very difficult or perhaps impossible for a computer to regulate the electrical stimulation applied to paralyzed legs so that the force produced by the legs versus the arms would result in the correct rowing motion. In addition, rowing machines only provide resistance in one direction. This means only about half of the body muscles are getting exercised significantly.

OBJECTS AND ADVANTAGES

Accordingly, several objects and advantages of my invention are:

(a) to provide an exercise machine which can be used by people with paralysis such as paraplegics and quadriplegics;

(b) to provide an exercise machine which utilizes electrical stimulation of approximately five or six muscle groups of the lower body;

(c) to provide an exercise machine which simultaneously exercises both the upper and lower body;

(d) to provide an exercise machine which will help an individual with paralysis reverse, halt, or at least slow down the progression of complications such as: muscle atrophy, pressure sores, osteoporosis, loss of joint range of motion, cardiovascular disease, lack of cardiovascular endurance, lower extremity blood clot formation, edema, and spasticity;

(e) to provide an exercise machine that can be easily and economically manufactured;

(f) to provide an exercise machine that is adjustable to individuals of various sizes; and (g) to provide an exercise machine that can be utilized in a clinic or hospital environment, as well as, being suitable for independent operation by an individual with paralysis at their home.

Further objects and advantages of my invention will become apparent from a consideration of the drawings and ensuing description.

DRAWING FIGURES

Figure 1:
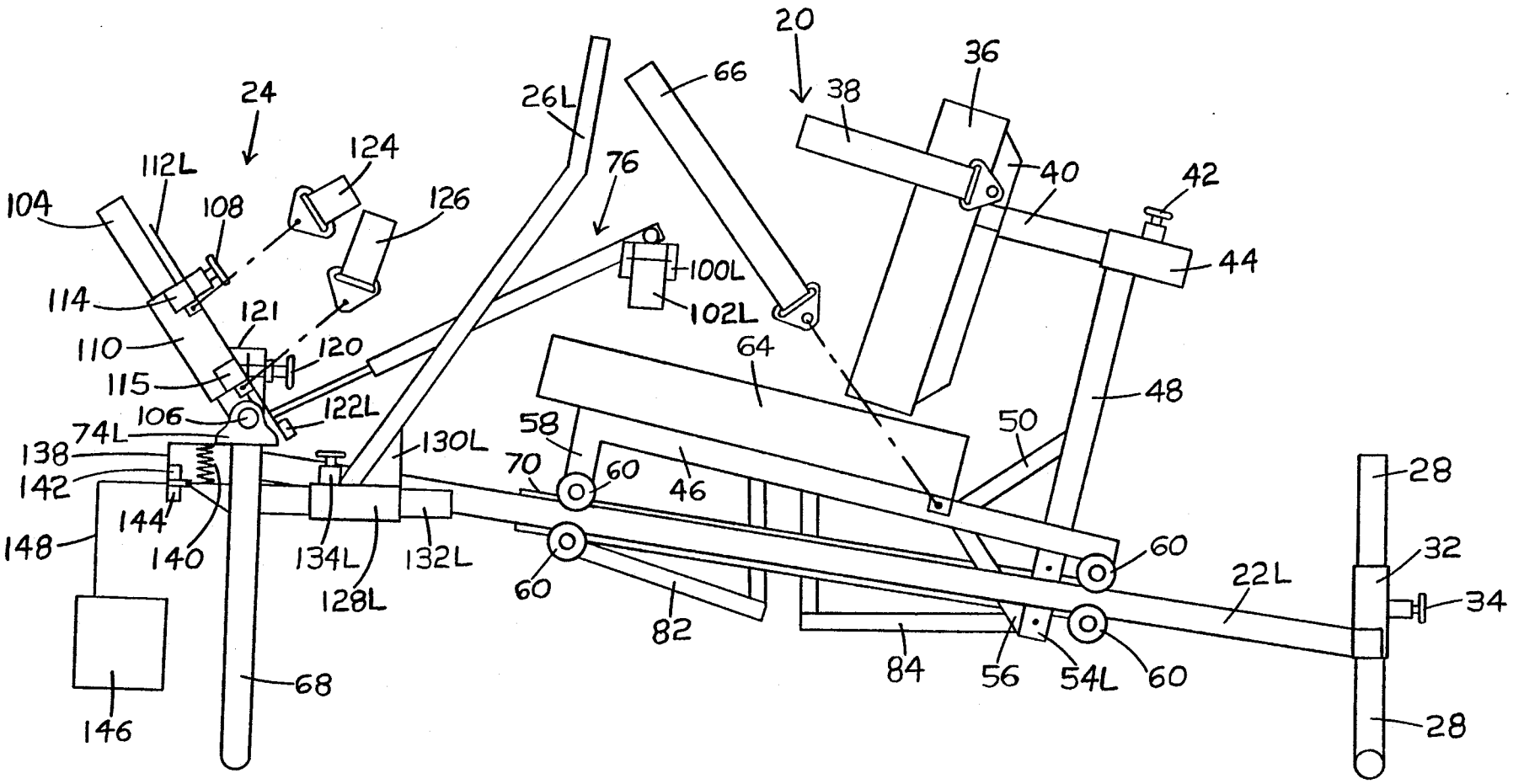
FIG. 1 is a side view of the preferred embodiment of my invention which has a seat that moves on wheels.

| Reference Numerals In Drawings | | | |
|---|---|---|---|
| 20 | seat assembly | 22L | left rail |
| 22R | right rail | 24 | foot plate assembly |
| 26L | left handgrip pole | 26R | right handgrip pole |
| 28 | rear support leg | 30 | cross member |
| 32 | sleeve | 34 | spring loaded |

-continued

| Reference Numerals In Drawings | | | |
|---|---|---|---|
| | | | adjustment pin |
| 36 | seat back | 38 | chest strap |
| 40 | seat back support frame | 42 | spring loaded adjustment pin |
| 44 | sleeve | 46 | seat bottom support frame |
| 48 | column | 50 | strut |
| 52L | left bearing | 52R | right bearing |
| 54L | extensions | 54R | extensions |
| 56 | strut | 58 | front wheel axle support |
| 60 | wheel | 62 | rear wheel axle support |
| 64 | seat bottom | 66 | seat belt |
| 68 | front frame member | 70 | double end road hydraulic cylinder |
| 72 | pivot | 74R | pillow block bearing for foot plate assembly |
| 74L | pillow block bearing for foot plate assembly | 76 | knee guide assembly |
| 78R | pillow block bearing for knee guide | 78L | pillow block bearing for knee guide |
| 80 | hydraulic cylinder trunnion | 82 | front hydraulic fluid line |
| 84 | rear hydraulic fluid line | 86 | flow control valve |
| 88 | flow control valve | 90 | hydraulic fluid passageway |
| 92 | pressure measurement device | 94 | rod |
| 96 | cylinder | 98 | threaded rod |
| 100L | thigh holder | 100R | thigh holder |
| 102L | thigh strap | 102R | thigh strap |
| 104 | foot plate support column | 106 | rod |
| 108 | spring loaded adjustment pin | 110 | sleeve |
| 112L | foot plate | 112R | foot plate |
| 114 | cross member | 115 | cross member |
| 116 | cross member | 117 | cross member |
| 118 | upright extension | 119 | foot plate angle adjustment screw |
| 120 | foot plate angle adjustment screw | 121 | housing |
| 122R | flange | 122L | flange |
| 124 | foot strap | 126 | foot strap |
| 128L | sleeve | 128R | sleeve |
| 130L | gusset | 130R | gusset |
| 132L | post | 132R | post |
| 134L | spring loaded adjustment pin | 134R | spring loaded adjustment pin |
| 136 | pivot | 138 | flange |
| 140 | compression spring | 142 | switch |
| 144 | switch | 146 | functional electrical stimulation unit |
| 148 | cable | 200 | seat assembly |
| 202 | swinging beam | 204 | strut |
| 206 | rod | 208 | bearing |
| 210 | horizontal beam | 212 | vertical beam |
| 214 | strut | 216 | base beam |
| 218 | strut | 220 | crossbeam |
| 222 | crossbeam | 224 | crossbeam |
| 226 | crossbeam | 228 | crossbeam |
| 230 | front frame member | 240 | seat assmbly |
| 242L | left foot plate assembly | 242R | right foot plate assembly |
| 244L | left handgrip pole | 244R | right handgrip pole |
| 246 | main frame | 248 | seat bottom support frame |
| 250 | column | 252 | strut |
| 254 | electrical stimulation unit | 256 | switch assembly |
| 258 | accessory crossbrace | 260 | bearing |
| 262 | bearing | 264 | bracket |
| 266 | trunnion | 268 | hydraulic cylinder |
| 269 | pivot pin | 270 | connecting arm |
| 272 | cylinder | 274 | rod |
| 276 | bearing | 278 | bearing |
| 280 | pin | 282 | front pivot pole |
| 284 | pin | 286 | pin |
| 288 | bearing | 290 | bearing |
| 292 | rear pivot pole | 294 | pin |
| 296 | bearing | 298 | bearing |
| 300 | pin | 302 | pin |
| 304 | support frame | 306 | bearing |
| 308 | bearing | 310 | bearing |
| 312 | bearing | 314 | bearing |
| 316 | bearing | 318 | foot plate support column |

-continued

| Reference Numerals In Drawings | | | |
|---|---|---|---|
| 320 | rod | 322 | sleeve |
| 324 | spring loaded adjustment pin | 326 | knee guide assembly |
| 328 | rod | 330 | bearing |
| 332 | bearing | 334 | cylinder |
| 336 | threaded rod | 338 | thigh holder |
| 340 | thigh strap | | |

DESCRIPTION OF PREFERRED EMBODIMENT-FIGS. 1 TO 6

Figure 2:
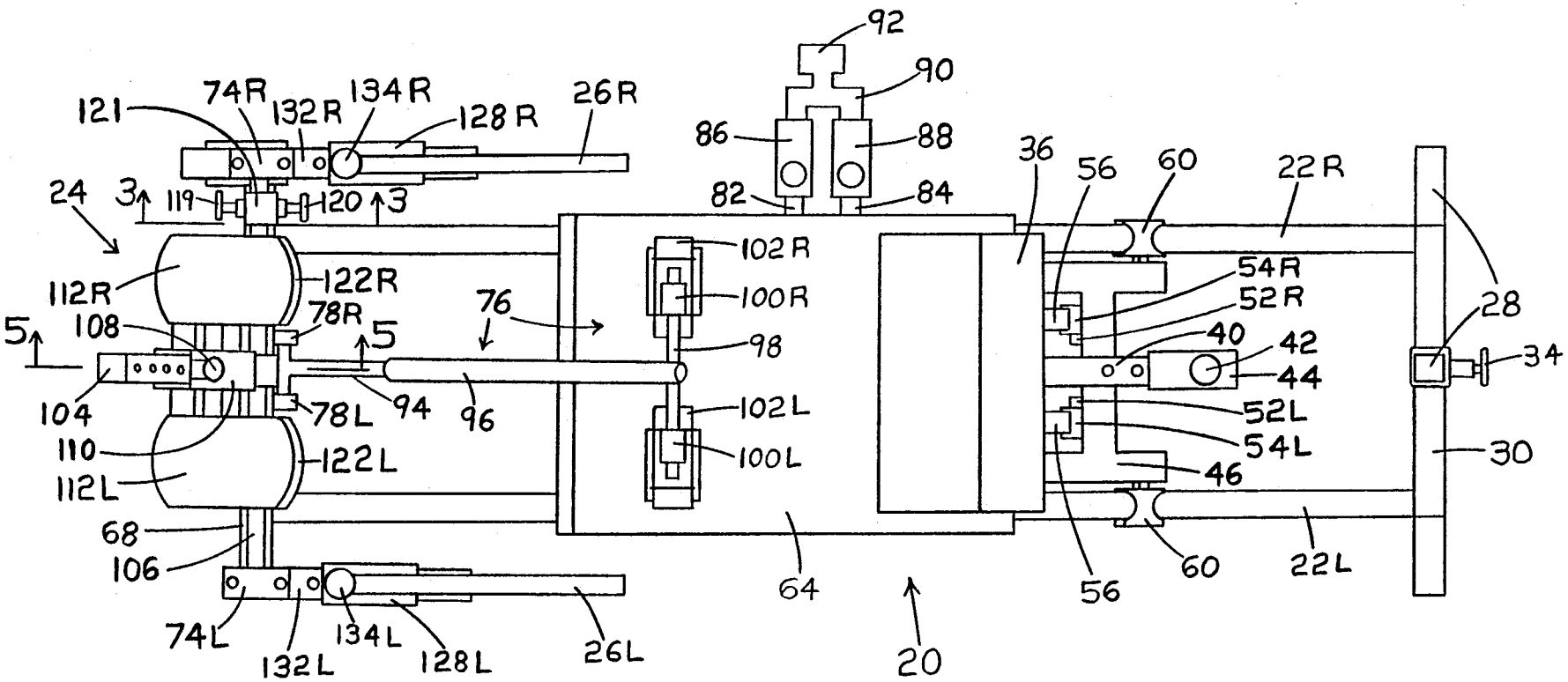
FIG. 2 is a partial top view of the preferred embodiment of my invention.

FIGS. 1 and 2 show side and top views of the exercise device which is the preferred embodiment of the invention. Basically, this embodiment consists of a seat assembly 20 which moves along a pair of round rails 22L and 22R. Attached to the front of the rails is a foot plate assembly 24 and a pair of handgrip poles 26L and 26R. Most of the frame for the exercise device is made of welded metal tubing.

Figure 6:
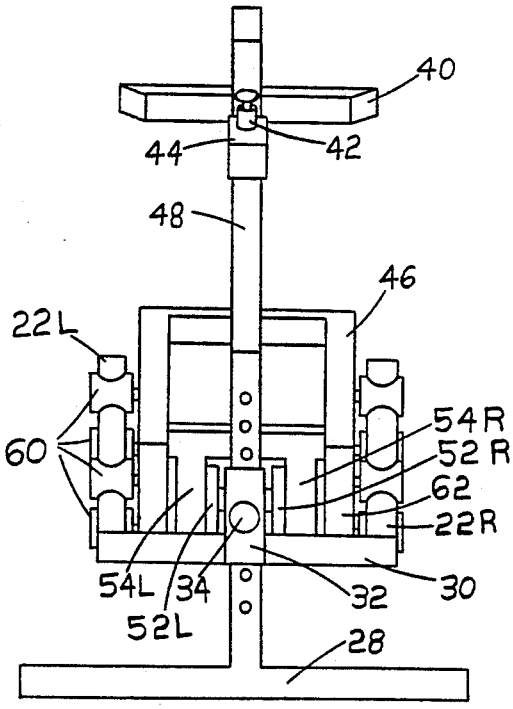
FIG. 6 is a partial rear view of the preferred embodiment of my invention.

FIGS. 1, 2, and 6 show how rails 22L and 22R are supported at the back of the exercise device. The back of rails 22L and 22R connect with a cross member 30 which has a sleeve 32 at its center. Sleeve 32 goes over a rear support leg 28 that is shaped like an inverted T. Rear support leg 28 has multiple holes in its back surface, as shown in FIG. 6, to accept a spring loaded adjustment pin 34 that is part of sleeve 32. This prevents sleeve 32 from sliding toward the base of rear support leg 28.

FIGS. 1, 2, and 6 show the structure of seat assembly 20. A seat back 36 is made of vinyl covered foam on a wood base. A chest strap 38 of construction similar to a car seat belt attaches to the wood base of seat back 36, as shown in FIG. 1. Seat back 36 attaches to a seat back support frame 40 which has multiple holes in its top surface as shown in FIG. 2. These holes accept a spring loaded adjustment pin 42 which mounts to a sleeve 44. Sleeve 44 goes over a portion of seat back support frame 40 and attaches to a seat bottom support frame 46 through a column 48. Column 48 is given additional support through a strut 50, as shown in FIG. 1. A pair of bearings 52R and 52L mount to a pair of extensions 54R and 54L which connect to seat bottom support frame 46. A strut 56, as shown in FIG. 1, is used to provide additional support to extensions 54R and 54L. A front wheel axle support 58 extends down from each front corner of seat bottom support frame 46 and provides a place for attaching a pair of wheels 60 at each front corner. A rear wheel axle support 62, as shown in FIG. 6, extends down from each rear corner of seat bottom support frame 46 and provides a means of attaching wheels 60 at the rear. A seat bottom 64 is made of vinyl covered foam on a wood base. Seat bottom 64 attaches to seat bottom support frame 46. A seat belt 66, attaches to the wood base of seat bottom 64.

A front frame member 68, that is shaped like a square, is a common attachment point for many parts. Rails 22L and 22R attach to the top of front frame member 68, as shown in FIG. 1 and 2.

Figure 4:
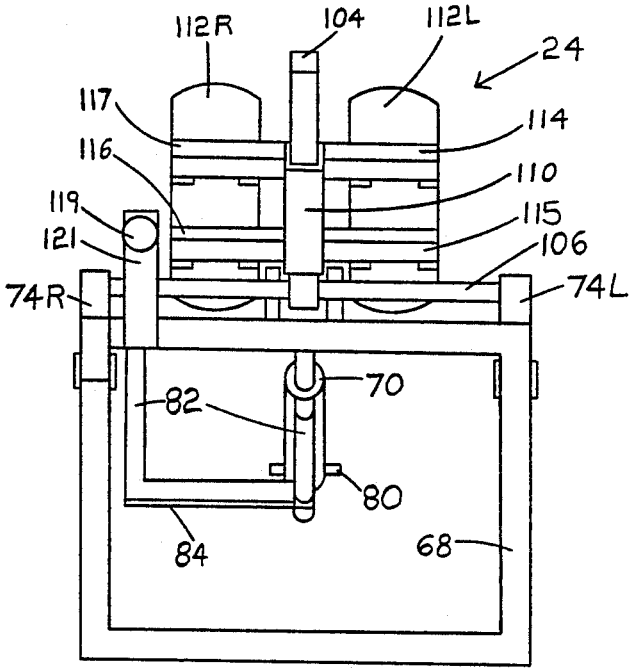
FIG. 4 is a partial front view of the preferred embodiment of my invention.
Figure 5:
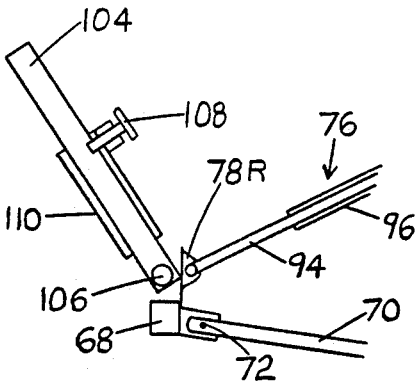
FIG. 5 is a partial view in detail of the portion indicated by the section lines 5—5 in FIG. 2.

A double end rod hydraulic cylinder 70 has the front of its cylinder rod mounted to a pivot 72 on the top center of front frame member 68, as shown in FIG. 5. FIG. 4 shows a trunnion 80 on hydraulic cylinder 70 which mounts into bearings 52L and 52R, shown in FIGS. 2 and 6, of the seat assembly 20. As shown in FIGS. 1, 2, and 4, a flow control valve 86 connects the front of hydraulic cylinder 70 through a front hydraulic fluid line 82. A flow control valve 88 connects to the rear of hydraulic cylinder 70 through a rear hydraulic fluid line 84. The other ends of flow control valves 86 and 88 connect with a hydraulic fluid passageway 90 that has a pressure measurement device 92 in the middle of it. Flow control valves 86 and 88 have adjustable resistance to fluid flow in one direction while allowing free flow in the opposite direction. Flow control valve 86 resists fluid flow to the front of hydraulic cylinder 70 while valve 88 resists flow to the rear of hydraulic cylinder 70.

As best shown in FIGS. 2 and 5, a knee guide assembly 76 attaches with a pair of pillow block bearings 78R and 78L to mounting tabs projecting up from the top inside edge of front frame member 68 thus knee guide assembly 76 will travel through a vertical plane. Knee guide assembly 76 consists of a rod 94 which rides on bushings within a cylinder 96. A threaded rod 98 attaches to the end of cylinder 96, as shown in FIG. 2. A pair of padded lower human thigh holders 100L and 100R thread onto threaded rod 98. Thigh holders 100L and 100R are of a size to fit approximately one third of the way around a thigh and are securable to a thigh with a pair of hook-and-loop fastening straps 102L and 102R.

Foot plate assembly 24 mounts to the top surface of front frame member 68 with a pair of pillow block bearings 74R and 74L, as shown in FIGS. 1, 2, and 4. Foot plate assembly 24 is made up of several parts. A foot plate support column 104 mounts on a rod 106 which pivots in bearings 74R and 74L. A sleeve 110 fits over column 104. Support column 104 has multiple holes in its surface, as shown in FIG. 2. These holes accept a spring loaded adjustment pin 108 which is mounted to sleeve 110, as shown in FIGS. 1 and 5.

Figure 3:
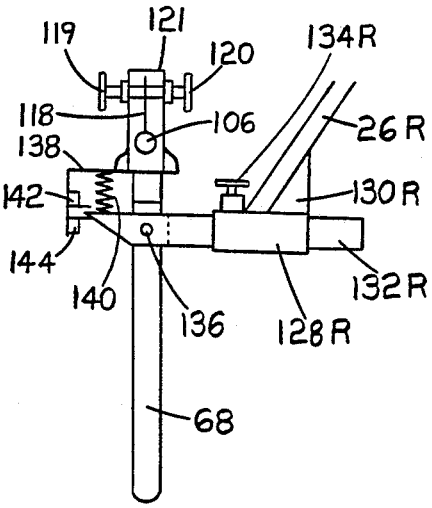
FIG. 3 is a view in detail of the portion indicated by the section lines 3—3 in FIG. 2.

A pair of foot plates 112L and 112R are mounted to sleeve 110 with a group of 4 cross members 114, 115, 116, and 117, as best shown in FIG. 4. Even though foot plate assembly 24 mounts in bearings 74R and 74L, it is held stable by the following structure. As shown in FIG. 3, a strong upright extension 118 of rod 106 is pinched between a pair of foot plate angle adjustment screws 119 and 120. Angle adjustment screws 119 and 120 thread into a housing 121 which mounts to the top of front frame member 68. Foot plates 112R and 112L each have a flange 122R and 122L at their base, as shown in FIGS. 1 and 2. A pair of foot straps 124 and 126 mount to each foot plate 112R and 112L, as shown in an exploded view in FIG. 1. Foot straps 124 and 126 utilize hook-and-loop fasteners for adjustments.

As shown in FIGS. 1, 2, and 3, the handgrip poles 26L and 26R mount to a pair of sleeves 128L and 128R with additional support provided to this connection by a pair of gussets 130L and 130R. Sleeves 128R and 128L have adjustable positions along a pair of posts 132R and 132L. A pair of spring loaded adjustments pins 134R and 134L attach to sleeves 128R and 128L. Adjustment pins 134R and 134L set in holes in the top surface of posts 132L and 132R to lock sleeves 128R and 128L to posts 132R and 132L. Post 132L attaches directly to front frame member 68, as shown in FIG. 1.

As shown in FIG. 3, post 132R mounts on a pivot 136 to front frame member 68. The front end of post 132R straddles front frame member 68 in such a way that only a few degrees of pivoting occurs in either direction from perpendicular. A flange 138 attaches to front frame member 68. A stiff compression spring 140 mounts to flange 138. The front of post 132R rests against the base of spring 140 when post 132R is perpendicular to frame member 68. A pair of switches 142 and 144 are located on flange 138 so their triggers, which are spring loaded to the off position, are slightly above and below the front tip of post 132R. As shown in FIG. 1, switches 142 and 144 connect to a functional electrical stimulation unit 146 through a cable 148.

Operation of Preferred Embodiment-FIGS. 1 to 6

The exercise device shown in FIGS. 1 to 6 enables an individual with lower body paralysis to get effective full body exercise. A typical individual with complete paraplegia will have no voluntary muscle function below the waist. Such an individual rolls his/her wheelchair next to the left side of this exercise device and uses arm strength to transfer over to seat assembly 20. Seat assembly 20 supports the individual's trunk. Arms are used to place feet onto foot plates 112L and 112R. Foot straps 124 and 126 are fastened so as to firmly hold the feet against foot plates 112L and 112R and flanges 122L and 122R. The knee guide assembly 76 attaches to the legs by placing thigh holders 100L and 100R on top of the thigh just above the knee and securing them with thigh straps 102L and 102R which go around the thigh. The individual then puts on seat belt 66. Chest strap 38 is optional and is used with individuals that lack trunk stability such as quadriplegics.

The exercise motion is described below. The individual grasps with the left and right hand the top portion of handgrip poles 26L and 26R respectively. One uses upper body strength to pull oneself toward foot plate assembly 24. As one does this, seat assembly 20 rolls up rails 22L and 22R. The shape of wheels 60 prevents seat assembly 20 from falling off of rails 22L and 22R. As seat assembly 20 moves forward the individuals knees and hips flex and the ankles dorsi flex. The knees are prevented form falling towards the center or out to the sides by knee guide assembly 76. Since the pivot points of the human body are different than that of knee guide assembly 76, rod 94 slides within cylinder 96 so that knee guide assembly 76 changes length. This prevents any hindering of the forward or backward motion of the legs. Once the individual comes far enough forward that the front edge of seat bottom 64 is almost touching the back of the individuals lower leg, the individual pushes with upper body strength on hand grip poles 26L and 26R. Seat assembly 20 changes direction and travels down rails 22L and 22R. As this occurs, the individual's knees and hips extend and the ankles plantar flex. The knees will not hyperextend because the front portion of seat bottom 64 is higher than a line drawn between the rear portion of seat bottom 64 and the individual's heels. Thus, an individual with lower body paralysis is able to safely perform the exercise motion utilizing only upper body strength. Refer to the latter part of this operational description for an explanation on performing the exercise using electrical stimulation.

Resistance to the exercise motion is applied by resisting the forward and backward motion of seat assembly 20. As seat assembly 20 moves forward hydraulic fluid is forced out of the rear of double end rod hydraulic cylinder 70 through fluid line 84. Hydraulic fluid free flows in this direction through flow control valve 88 and its flow is then restricted by flow control valve 86. This causes a build-up of pressure in hydraulic fluid passageway 90 and a display of this pressure on pressure measurement device 92. The fluid then travels to the front of hydraulic cylinder 70 through fluid line 82. When the seat assembly moves backward the hydraulic fluid flows in the reverse direction and free flows through valve 86 and is restricted by valve 88. Again, a pressure is displayed on pressure measurement device 92. By adjusting the amount of restriction of valves 86 and 88, the resistance to forward and backward motion of seat assembly 20 is set independently.

The slope of rails 22L and 22R will influence the force required to move seat assembly 20 forward or backward, especially if a heavy individual uses the exercise device. The height that the rear of rails 22R and 22L are off the ground is adjusted by pulling spring loaded adjustment pin 34 and raising or lowering sleeve 32 until the desired slope of rails 22L and 22R is achieved. When pin 34 is released, it engages into one of the holes in the back surface of rear support leg 28.

The best way of adjusting the combination of hydraulic and slope resistance is explained below. Set the forward hydraulic resistance very low and adjust the slope to give desired forward resistance. Next, adjust the rearward hydraulic resistance to give desired rearward motion resistance. By setting up the exercise device in this manner, most of the resistance to forward motion is the result of gravity acting on the exercising individual who is pulling themselves uphill. This is much preferred over having rails 22L and 22R set more level and having greater forward hydraulic resistance, for this would result in a tendency to pull oneself forward off the seat, since most of the resistance would be applied through the seat.

The exercise device accommodates individuals of many different body sizes. Seat back 36 is adjustable backward and forward by pulling spring loaded adjustment pin 42, moving seat back 36 to desired position and then releasing pin 42 into one of the holes in the top surface of seat back support frame 40. A short legged person needs seat back 36 in a forward position while a long legged person needs seat back 36 in a rearward position. Handgrip poles 26L and 26R are positioned forward or backward on posts 132L and 132R with adjusting pins 134L and 134R. Adjustment pin 108 allows the height of foot plates 112L and 112R to be adjusted along foot plate support column 104. The height of foot plates 112L and 112R are set so that the knees will go straight but will not hyperextend during the exercise motion. The angle of foot plate assembly 24 is set with foot plate angle adjustment screws 119 and 120. By loosening screw 119 and tightening screw 120, foot plates 112L and 112R will move in the plantar flexion direction and by loosening screw 120 and tightening screw 119 it moves the feet to a more dorsi flexed position. This is an important function since most people with lower body paralysis have limited ankle range of motion. It is important to have foot plates 112L and 112R set so that the individual is exercising in the middle range of their ankle range of motion.

Through the use of functional electrical stimulation the lower body muscles of an individual with lower body paralysis are made to contract and contribute forces to perform the exercise motion against greater resistances than the upper body alone can handle. When an average paraplegic with complete paralysis from the waste down performs the exercise motion with electrical stimulation, there are two phases of exercise motion. When no external pressure other than gravity is applied to right handgrip pole 26R, the front portion of post 132R rests against compression spring 140 so that the front tip of post 132R is centered between the triggers of switches 142 and 144. When the individual pulls on handgrip poles 26L and 26R to begin his/her movement toward foot plate assembly 24, spring 140 compresses and right handgrip pole 26R pivots a few degrees backwards on pivot 136. When this occurs, the front tip of post 132R rises and turns on switch 142. Switch 142 signals functional electrical stimulation unit 146 to stimulate the tibialis anterior muscles and hamstring muscles of both legs causing ankle dorsi flexion and knee flexion forces to be generated. Since the feet are fixed to foot plates 112L and 112R with straps 124 and 126, these ankle dorsi flexion forces and knee flexion forces help bring the individual forward.

When the individual reaches the forward position, the second phase of the exercise motion begins. The individual stops pulling on handgrip poles 26L and 26R and begins pushing forward on them. When forward pressure is applied to handgrip pole 26R it pivots forward a few degrees. The front portion of post 132R separates from the bottom of spring 140. The front tip of post 132R allows switch 142 to turn off and continues downward to turn on switch 144. Turning off switch 142 stops the electrical stimulation of the tibialis anterior and hamstring muscles. Turning on switch 144 causes electrical stimulation of the gastrocnemius, quadriceps, and gluteus maximus resulting in ankle plantar flexion, knee extension, and hip extension forces respectively. This allows the individual to apply a strong rearward pressure to seat assembly 20. Once the individual has gone back far enough that the knees are almost straight, forward force on handgrip poles 26L and 26R is stopped and replaced with rearward force. The individual moves forward and backward in a continuous rhythmical fashion. Most individuals can probably perform between 15 and 45 forward and back cycles per minute.

The functional electrical stimulation (FES) unit 146 can be obtained from one of several manufacturer's of electrical stimulation equipment. The FES Information Center, 11000 Cedar Avenue, Cleveland, Ohio 44106, is an excellent source of information on functional electrical stimulation and manufacturer's of functional electrical stimulation equipment.

The functional electrical stimulation unit 146 will have the following capabilities. It will be able to stimulate a predetermined number of muscles on both the right and left side of the body. The muscles are selected from the group comprising tibialis anterior, gastrocnemius, hamstring, quadricep, gluteus maximus, paraspinal, and abdominal muscles. The periods of time in which stimulation is administered and the muscles that are stimulated are controllable through switches 142 and 144. The peak milliamps of current administered will be adjustable independently for each muscle. The ramp up time will be adjustable. Ramp up time is the time period it takes for the stimulation current to gradually increase from zero milliamps to the predetermined peak milliamps of each muscle. This allows the muscle force in the legs to build gradually which produces a smooth transition when changing direction during the exercise motion. The maximum time of a single stimulation period will be adjustable; this is a safety feature that shuts off the electrical stimulation after a predetermined number of seconds even though switch 142 or 144 is still being held in the on position.

The specific type of electrical stimulation administered varies depending on the nature of each individual's paralysis. Because of this it is ideal to have a stimulator that is capable of producing a variety of stimulation wave forms, pulse widths, and frequencies. The field of electrical stimulation is growing rapidly and there is constantly more information becoming available on what type of electrical stimulation works best with a specific type of paralysis. Thus, the stimulation parameters of wave form, pulse width, and frequency will be determined on an individual basis.

Figure 7:
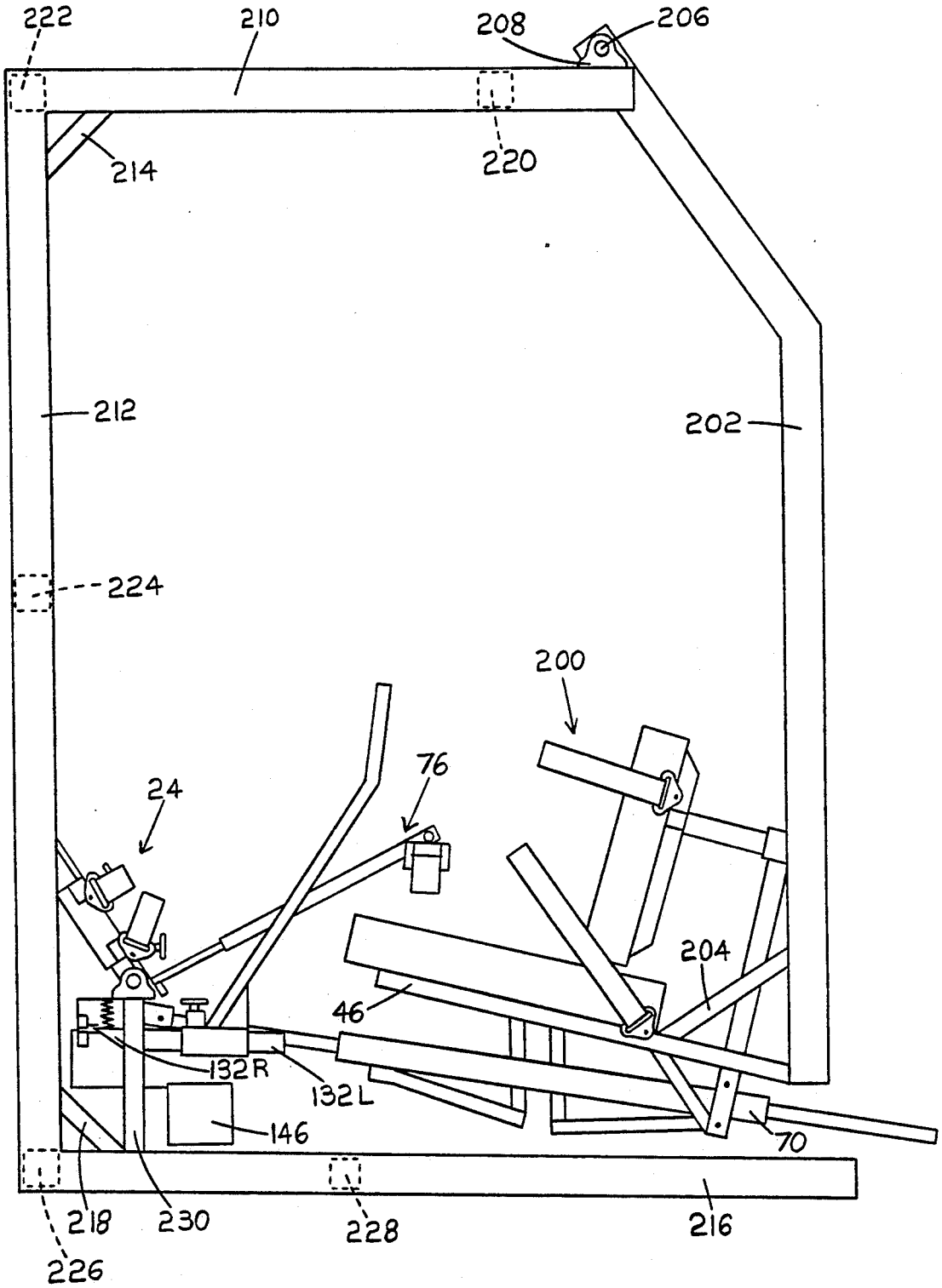
FIG. 7 is a side view of an alternate embodiment of my invention which has a suspended seat that moves like a pendulum.

Description-FIG. 7

FIG. 7 is a side view of an exercise device that shares many parts with and functions much like the exercise device shown in FIGS. 1 to 6 and described above. The main difference between the two exercise devices is that a seat assembly 200 of FIG. 7 swings like a pendulum while seat assembly 20 of FIG. 1 rolls. Since the exercise device shown in FIG. 7 is so similar to the one already described, most of the parts shared by the two exercise devices are not described again and are not labelled on FIG. 7.

As shown in FIG. 7, seat assembly 200 connects to a pair of swinging beams 202 through seat bottom support frame 46. This connection is given additional support through a pair of struts 204. The tops of swinging beams 202 connect with a rod 206 which rides in a pair of bearings 208. Bearings 208 attach to the top of a pair of horizontal beams 210. Horizontal beams 210 attach to the top of a pair of vertical beams 212. This connection is given additional support through a pair of struts 214. Vertical beams 212 connect with a pair of base beams 216. This connection is given additional support through a pair of struts 218. Because FIG. 7 is a side view, only the left swinging beam 202, horizontal beam 210, vertical beam 212, and base beam 216 are shown. However, the right beams are identical and the right and left sides connect with a number of crossbeams 220, 222, 224, 226, and 228.

Foot plate assembly 24, knee guide assembly 76, and posts 132L and 132R mount to a front frame member 230 in the same manner as these parts mount to front frame member 68 in FIGS. 1 to 5. Front frame member 230 attaches to base beam 216. Functional electrical stimulation unit 146 is controlled in the same manner as the previously described exercise device in FIGS. 1 to 6. Hydraulic cylinder 70 mounts and is controlled in the same manner as previously described.

Operation-FIG. 7

The operation of the exercise device shown in FIG. 7 is identical to that of the exercise device shown in FIGS. 1 to 6 with the following exceptions. Seat assembly 200 follows an arched path by pivoting in bearings 208. There is no adjustment provided for influencing the slope of the arched path of the seat assembly 200 toward foot plate assembly 24. However, this adjustment is possible if horizontal beams 210 are constructed so as to have an adjustable length.

Figure 8:
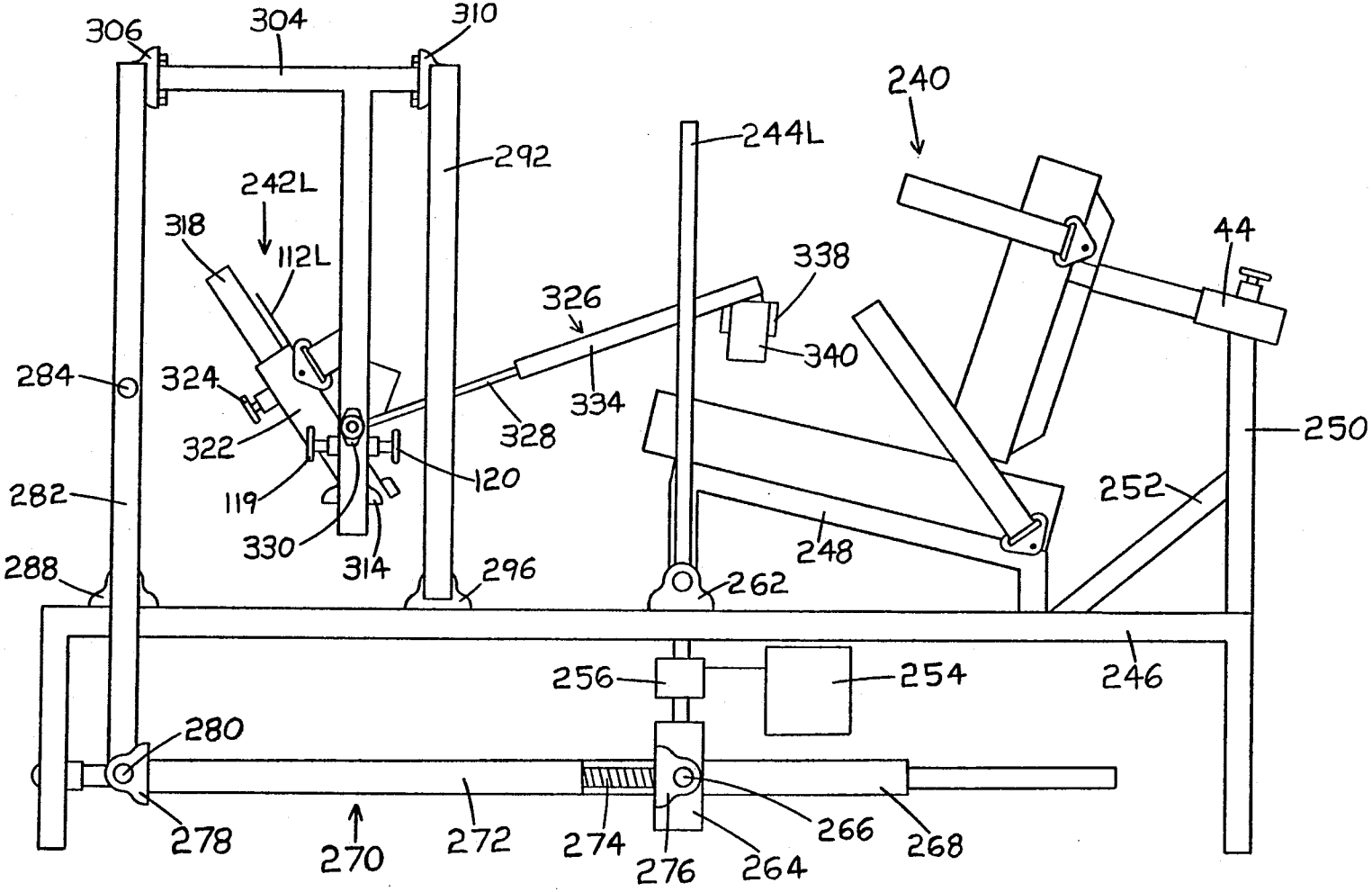
FIG. 8 is a partial side view of a more complex embodiment of my invention with foot plates and handgrip poles that move.
Figure 10:
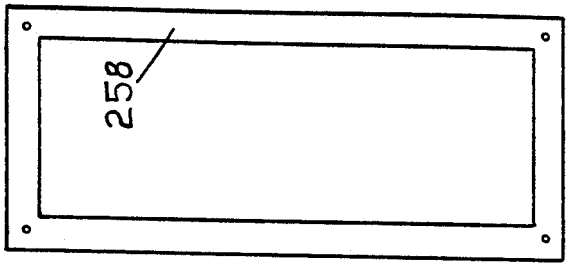
FIG. 10 is a top view of an accessory brace used with embodiment shown in FIG. 8 and 9.
Figure 9:
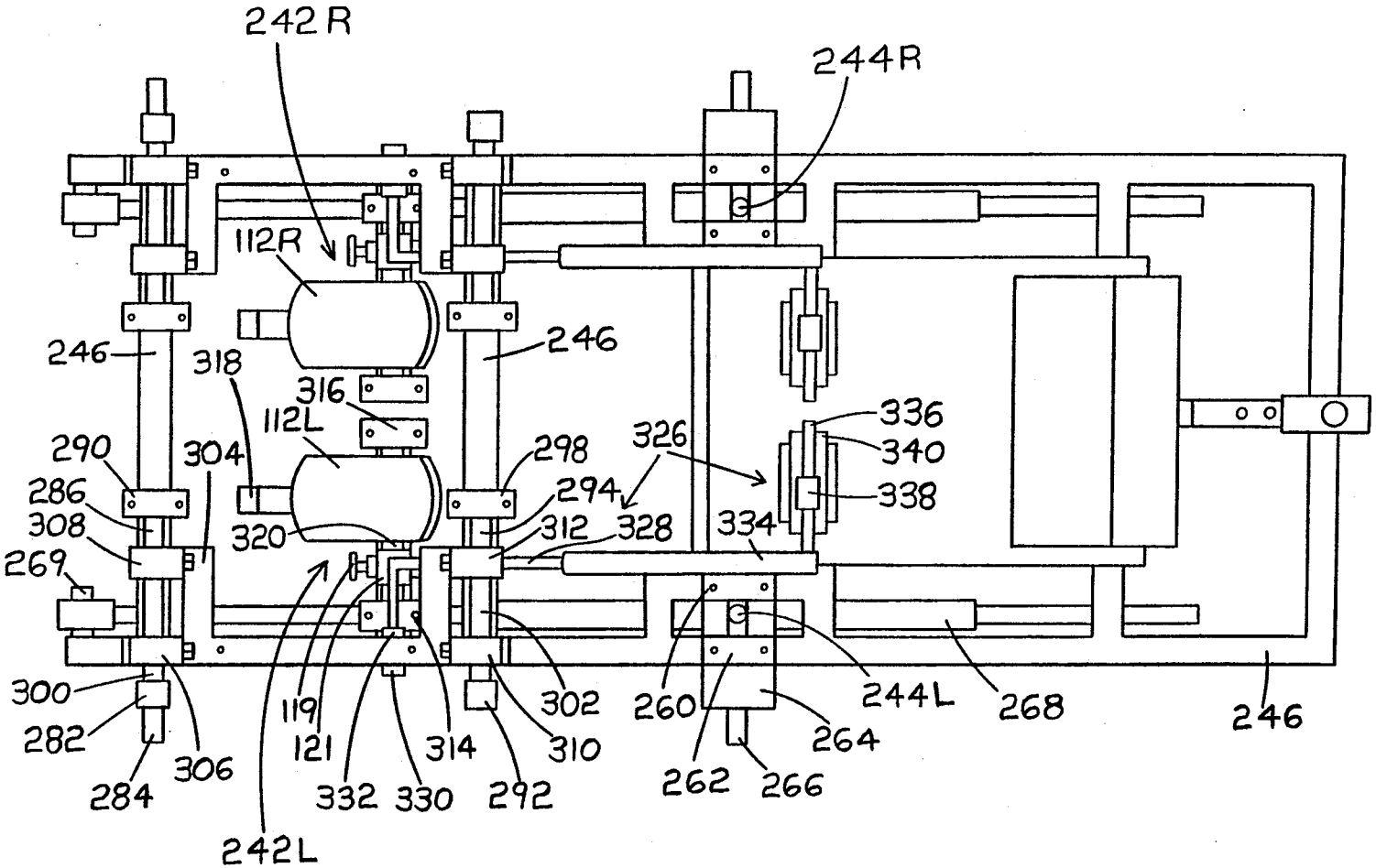
FIG. 9 is a partial top view of the same embodiment as FIG. 8.

Description-FIGS. 8, 9, and 10

The exercise device shown in FIGS. 8, 9, and 10 uses many of the same parts as the exercise devices described above. Mostly, just the parts that are unique to this exercise device are numbered and described. This exercise device has a stationary seat assembly 240, a pair of movable foot plate assemblies 242L and 242R, and a pair of movable handgrip poles 244L and 244R.

Seat assembly 240 attaches to a main frame 246 in the following manner. A seat bottom support frame 248 attaches to the top of main frame 246. Sleeve 44 attaches through a column 250 to main frame 246. A strut 252 provides additional support to column 250.

An electrical stimulation unit 254 receives input from two switch assemblies 256. One of these switch assemblies 256 mounts in series with handgrip pole 244L, as shown in FIG. 8, and the other switch assembly 256 mounts in series with handgrip pole 244R.

The rest of the parts described are duplicated on the right and left sides of the exercise device. The right side parts are mirror images of the left side parts. The only exception to this is an accessory crossbrace 258, shown in FIG. 10, which connects a right hand part to its mirror image left hand part in a manner which is described below. In general, only left side parts are described below and numbered on FIGS. 8 and 9.

Handgrip pole 244L has horizontal extensions that pivot in a pair of bearings 260 and 262. At the bottom end of handgrip pole 244L a bracket 264 attaches. Bracket 264 is a mounting point for a pair of bearings which hold a trunnion 266 of a double end rod hydraulic cylinder 268. Hydraulic cylinder 268 has a method of resisting the flow of hydraulic fluid between the front and rear of the cylinder. This method of resisting hydraulic fluid flow is similar to that shown for hydraulic cylinder 70 of the exercise device shown in FIGS. 1 to 6. The left side of trunnion 266 is long enough that it projects through bracket 264 and provides a point of attachement for a connecting arm 270. The front of hydraulic cylinder 268 mounts to a pivot pin 269 which extends from the inside of main frame 246.

Connecting arm 270 shown in FIG. 8 consists of the following. A cylinder 272 is threaded on the inside to accept a rod 274 which is threaded on the outside. A bearing 276 attaches the end of rod 274 to trunnion 266. A bearing 278 attaches the end of cylinder 272 to a pin 280. Pin 280 extends out from the side of a front pivot pole 282. A second attachment pin 284 is provided at the middle of front pivot pole 282. Front pivot pole 282 has a long mounting pin 286 which extends inward towards the right side of the exercise device. Mounting pin 286 is at a distance half way between pins 280 and 284. Bearings 288 and 290 connect pin 286 to main frame 246. A rear pivot pole 292 attaches to main frame 246 in an identical manner utilizing a pin 294 and a pair of bearings 296 and 298. A pair of pins 300 and 302 extend from the inside tops of pivot poles 282 and 292 respectively.

A support frame 304 connects at its front to pin 300 through a pair of bearings 306 and 308. Support frame 304 connects at its rear to pin 302 through a pair of bearings 310 and 312. The bottom of support frame 304 extends under foot plate assembly 242L, and a pair of bearings 314 and 316 attach to this extension. A foot plate support column 318 mounts in bearings 314 and 316 utilizing a rod 320. This is similar to the arrangement of foot plate support column 104, rod 106, and bearings 74L and 74R in FIGS. 1, 2, and 5. FIG. 3 shows a close-up of housing 121, foot plate angle adjustment screws 119 and 120, and upright extension 118 which are features included in the exercise device in FIGS. 8 and 9. Foot plate 112L attaches to a sleeve 322. Sleeve 322 goes around foot plate support column 318. Foot plate support column 318 has holes in its back surface that accept a spring loaded adjustment pin 324 which attaches to sleeve 322.

Accessory crossbrace 258 shown in FIG. 10 can be mounted to the top of left and right support frames 304. This links the motion of foot plate assemblies 242R and 242L.

A knee guide assembly 326 consists of the following parts. A rod 328 consists of a short and long portion joined at a right angle. The short portion pivots in a pair of bearings 330 and 332 that mount to support frame 304. The long portion rides on bushings within a cylinder 334. A threaded rod 336 attaches to the top of cylinder 334. A thigh holder 338 threads on to rod 336. A hook-and-loop thigh strap 340 attaches to thigh holder 338.

Operation-FIGS. 8, 9, and 10

With accessory crossbrace 258 mounted, the exercise device shown in FIGS. 8, 9, and 10 produces an exercise motion very similar to the motion produced by the exercise device shown in FIGS. 1 and 6. The main difference is that the human trunk remains stationary while the hands and feet follow a slightly arched path away from and toward the trunk.

When crossbrace 258 is installed, the basic parts of this exercise device move as follows. When a person pushes the top of handgrip poles 244L and 244R forward, the bottom moves backward. This causes movement of hydraulic cylinders 268 and rearward movement of connecting arms 270. Rearward movement of connecting arms 270 causes rearward movement of the bottom of front pivot poles 282 and forward movement at the top. This results in forward movement of the foot plate assemblies 242L and 242R. The angle of foot plates 112L and 112R remains constant because front and rear pivot poles 282 and 292 have equal lengths and are parallel. The reverse motion occurs when the top of handgrip poles 244L and 244R are pulled rearward.

This exercise device is also used to perform a rowing motion. However, unlike rowing machines, this device provides adjustable resistance in both directions. Connecting arms 270 are lengthened by unthreading some of rods 274 from cylinders 272 until bearings 278 are relocated to pins 284 while maintaining front pivot poles 282 and handgrip poles 244L and 244R in approximate vertical positions. Accessory crossbrace 258 remains installed. With the exercise device set up like this, the hands and feet always move in opposite directions. When the hands move toward the chest, the feet move away from the hips. When the hands move away from the chest, the feet move toward the hips.

This exercise device is also designed to allow the right and left sides of the body to move independently. When accessory crossbrace 258 is removed, right handgrip pole 244R and foot plate assembly 242R move independent of left handgrip pole 244L and foot plate assembly 242L. A hydraulic cylinder 268 is installed on the right and left sides, so resistance is adjusted independently. Thus, a side that may be weaker can be given less resistance while the stronger side can be given more resistance.

With accessory crossbrace 258 removed the exercise motions already explained can still be performed. In addition, new exercise motions can be performed. With connecting arms 270 attached to pins 280, a person moves the right hand and foot away from the trunk while moving the left hand and foot toward the trunk. This is followed by moving the right hand and foot toward the trunk while moving the left hand and foot away from the trunk. With connecting arms 270 attached to pins 284, the right hand and left foot move away from the trunk while the left hand and right foot move toward the trunk. This is followed by the right hand and left foot moving toward the trunk while the left hand and right foot move away from the trunk.

This exercise device has the same adjustments available to accommodate individuals of different sizes as the exercise device shown in FIGS. 1 to 6. The main difference is that the distance between the tops of handgrip poles 244L and 244R and foot plate assemblies 242L and 242R adjusts by slightly changing the lengths of connecting arms 270.

Electrical stimulation unit 254 has the same features as electrical stimulation unit 146 described earlier. Electrical stimulation unit 254 also has some additional features. It receives input from a left and a right switch assembly 256. These switch assemblies 256 detect which direction the handgrip poles are being forced by the upper extremities. Left switch 256 controls the electrical stimulation to the left side of the body while right switch 256 controls stimulation to the right side. The particular muscles that are stimulated when the tops of handgrip poles 244L and 244R move in a particular direction depends on the location of connecting arm 270. A switch is provided on stimulation unit 254 to program the location of the front of connecting arm 270, whether it be pin 280 or pin 284.

Summary, Ramifications, and Scope

Accordingly, the reader will see that the exercise devices of this invention are of great value to people with lower body paralysis. The general population is constantly reminded by health professionals and the media of the importance of regular exercise. It is well known that conditions such as cardiovascular disease can result from a sedentary lifestyle. People with lower body paralysis are sedentary to the point where they cannot voluntarily move half of their body. One can imagine what a detriment this is to the health of a person with lower body paralysis.

By utilizing the method of exercise of this invention, people with lower body paralysis can increase the strength and size of their muscles. An increase in muscle mass of and circulation to the buttocks should result in a decrease in the occurrence of pressure sores to this region. This exercise method is perhaps more likely to increase the strength of bones weakened by osteoporosis than any other exercise method. The rhythmic nature of the exercise motion and the large range of motion it puts the body joints through should help keep the joints healthy, pump out edema, and decrease lower body blood clot formation. In addition, this exercise method probably has the capability of developing the cardiovascular system beyond what has ever been recorded in a person with lower body paralysis. Scientific experiments will have to be performed to reveal all of the benefits this exercise method has to offer.

While the user of this exercise method is stated as an individual with complete lower body paralysis, other individuals can also use this exercise method. People with incomplete lower body paralysis can just hook up the electrical stimulation to the specific muscles that are paralyzed. Many people with both lower and upper body paralysis can still perform the exercise if their hands are fixed to the handgrip poles with an elastic wrap for example. They just need enough upper extremity function to trigger the switches that activate the electrical stimulation cycles. An able bodied individual can also use the exercise devices described; in this case a knee guide assembly and electrical stimulation is not necessary.

Although the descriptions above contain many specificities, these should not be construed as limiting the scope of the invention but as merely providing illustrations of some of the presently preferred embodiments of this invention. Thus, the scope of the invention should be determined not by the embodiments illustrated, but by the appended claims and their legal equivalents.

I claim:

1. A method of exercise for a human comprising the steps of:

(a) producing an arm motion in which the distance between the hands and chest of the human increases and decreases, (b) producing a leg motion in which the distance between the ankles and the hips of the human increases and decreases, (c) providing a means for connecting said arm motion to said leg motion so that said arm motion causes said leg motion, (d) providing a means for resisting said arm motion and said leg motion, and (e) providing an exercise device with a means for holding the feet of the human so that contraction of the gastrocnemius muscle at one phase of the exercise and contraction of the tibialis anterior muscle at another phase of the exercise contributes to overcoming said means for resisting.

2. The method of exercise of claim 1, further providing a means for attaching the central portion of the human's leg to said exercise device so that the human's knees travel in a vertical plane, whereby the human if having lower extremity paralysis is able to safely perform said leg motion through the performance of said arm motion.

3. The method of exercise of claim 1, further providing a means for supporting the human's trunk.

4. The method of exercise of claim 1, further providing a functional electrical stimulation means for producing leg muscle contractions during said leg motion.

5. The method of exercise of claim 4, further providing that said functional electrical stimulation means produces said leg muscle contractions in different leg muscles at different times during said leg motion so that forces generated by said leg muscle contractions contribute to the overcoming of said means for resisting said arm motion and said leg motion.

6. The method of exercise of claim 5, further providing a switching means which is activated by said means for connecting said arm motion to said leg motion and controls the administering of said functional electrical stimulation means to said different leg muscles in response to forward or rearward arm motion.

7. The method of exercise of claim 5, further providing an adjustable means for physically preventing the hyperextension of the human's knee joint during said leg motion.

8. An exercise apparatus for a human comprising:

(a) a frame, (b) human trunk supporting means connected to said frame, (c) handgrip means which is connected through said frame to said human trunk supporting means in a manner that allows the distance between said handgrip means and said human trunk supporting means to be increased and decreased, whereby the human exercising on said exercise apparatus would experience an increase and decrease in the distance between their hands and chest, (d) foot holding means which is connected through said frame to said human trunk supporting means in a manner that allows the distance between said foot holding means and said human trunk supporting means to be increased and decreased, whereby the human exercising on said exercise apparatus would experience an increase and decrease in the distance between their ankles and hips, (e) means for connecting said handgrip means to said foot holding means so that a change in distance between said handgrip means and said human trunk supporting means will cause a proportional change in the distance between said foot holding means and said human trunk supporting means, (f) means for resisting the change of distances of said handgrip means and said foot holding means to said human trunk supporting means, and (g) means for maintaining a nearly constant angle of said foot holding means in relation to said frame, whereby the human exercising on said exercise apparatus could use forces generated from their tibialis anterior and gastrocnemius muscles acting through their ankle joint to help overcome said means for resisting.

9. The exercise apparatus of claim 8, further comprising a knee guiding means which has variable length and is pivotally attached at one end to said frame so as to enable it to travel in a vertical plane between said human trunk supporting means and said foot holding means while the other end has a pair of adjustable supports suitable for attachment to the central portion of a human leg, whereby said knee guiding means will prevent the knees of a human with lower body paralysis from knocking together or falling to the outside while exercising on said exercise apparatus.

10. The exercise apparatus of claim 8, further comprising a functional electrical stimulation means which can stimulate paralyzed leg muscles to generate force producing contractions.

11. The exercise Apparatus of claim 10, wherein said handgrip means activates a switching means that causes said functional electrical stimulation means to stimulate a different predetermined group of muscles during the periods of time when the distance between the foot holding means and the human trunk supporting means is increasing and decreasing, whereby a human's paralyzed leg muscles will be stimulated to produce forces that will help to overcome said means for resisting the change of distances of said handgrip means and said foot holding means to said human trunk supporting means.

12. The exercise apparatus of claim 10, further comprising a knee hyperextension preventing means which is part of said human trunk supporting means, whereby the knees of a paralyzed leg exercising on said exercise apparatus will be prevented from hyperextending even when quadriceps are stimulated to contract by said functional electrical stimulation means.

* * * * *